US005163207A

United States Patent [19]

Krautz et al.

[11] Patent Number: 5,163,207

[45] Date of Patent: Nov. 17, 1992

[54] SHOCK PROOF BUCKLE FOR SAFETY BELTS

[75] Inventors: Kurt Krautz, Rosengarten; Andreas Bock, Nortorf; Jan Baumann, Uetersen, all of Fed. Rep. of Germany

[73] Assignee: Autoflug GmbH & Co. Fahrzeugtechnik, Rellingen, Fed. Rep. of Germany

[21] Appl. No.: 761,804

[22] PCT Filed: Mar. 15, 1989

[86] PCT No.: PCT/DE90/00187

§ 371 Date: Oct. 25, 1991

§ 102(e) Date: Oct. 25, 1991

[87] PCT Pub. No.: WO90/10397

PCT Pub. Date: Sep. 20, 1990

[30] Foreign Application Priority Data

Mar. 15, 1989 [DE] Fed. Rep. of Germany ..... 3908417

[51] Int. Cl.[5] ..... A44B 11/25

[52] U.S. Cl. ..... 24/633; 24/641

[58] Field of Search ..... 24/633, 634, 635, 641, 24/642, 643, 196; 280/806

[56] References Cited

U.S. PATENT DOCUMENTS

| | | | |
|---|---|---|---|
| 4,384,391 | 5/1983 | Lindblad et al. | 24/633 |
| 4,385,425 | 5/1983 | Tanaka et al. | 24/633 |
| 4,527,317 | 7/1985 | Strasrewski et al. | 24/641 |
| 4,597,141 | 7/1986 | Wier | 24/633 |

FOREIGN PATENT DOCUMENTS

| | | | |
|---|---|---|---|
| 0114332 | 8/1984 | European Pat. Off. | 24/641 |
| 3533684 | 2/1987 | Fed. Rep. of Germany . | |
| 2010955 | 7/1979 | United Kingdom | 24/641 |

*Primary Examiner*—Victor N. Sakran

*Attorney, Agent, or Firm*—Robert W. Becker & Associates

[57] ABSTRACT

A buckle for a safety belt, especially for motor vehicles, for receiving and locking an insertion tongue. A locking latch is provided that is biased in an opening direction and is pivotably mounted in a buckle housing such that in a locking position the locking latch extends into a recess of the insertion tongue. A locking bar is movably mounted in the housing at an angle to an insertion path of the insertion tongue, with the locking bar securing the locking latch in the locking position thereof. A sliding key is guided transverse to a plane of movement of the locking latch for cancelling the locking position thereof via actuation of the locking bar. To protect the buckle from shock, a compensating mass is mounted in the housing such that it is movable relative to the locking bar. The compensating mass serves for fixing the locking bar in position. During acceleration in the same direction as a pushing-in direction of the sliding key, the compensating mass directly supports the locking bar and fixes the position thereof. A spring is supported on the buckle for spring-loading the compensating mass toward a position that fixes the locking bar.

16 Claims, 6 Drawing Sheets

SHOCK PROOF BUCKLE FOR SAFETY BELTS

BACKGROUND OF THE INVENTION

The invention relates to a safety belt buckle or lock, especially for motor vehicles, for receiving and locking an insertion tongue or lug, and includes a housing having an insertion passage for the insertion tongue that also contains a spring-loaded ejector, with a locking latch that is biased in an opening direction being pivotably mounted in the buckle such that in a locking position the locking latch engages the tongue recess, with the locking latch being secured in its locking position by a locking bar that is movably mounted in the housing at an angle to the insertion path for the buckle tongue, and with a sliding key that is guided transverse to a plane of movement of the locking latch for cancelling the locking action by actuating the locking bar, whereby to protect the buckle from shock, a compensating mass is mounted in the housing and in the direction of acceleration that is in the same direction as the pushing-in direction of the sliding key fixes the locking bar in position.

A safety belt buckle of this general type is disclosed inter alia in DE-OS 35 33 684, and in particular in the form of a so-called servo-lock where the locking latch that blocks the insertion tongue, due to the cinematics of the lock, has an opening bias or tendency, for which reason it is secured in the locked position by a special locking bar. The sliding key that is provided for opening the lock or buckle thereby merely actuates the locking bar, after the pivoting of which from the securing position into a release position, the locking latch swings out of the tongue recess, so that the buckle is unlocked.

If such a servo-lock is subjected to a tightening procedure, the buckle body is first subjected to an acceleration in the direction of the pushing-in movement of the sliding key; in so doing, the mass inertia of the locking bar leads to a retardation relative to the buckle body, and the resulting relative movement relative to the buckle body lets the locking bar pivot into its release position for the locking latch. At the end of the tightening procedure, the buckle body is suddenly decelerated, so that due to its own mass inertia, the sliding key slides into the buckle body and thus in turn actuates the locking bar to effect self-opening of the buckle. Consequently, tensioning movements of the buckle can result in automatic or self-opening of the buckle when the two types of acceleration occur.

With the known buckle, measures have already been taken for protecting the buckle against shock. For this purpose, with the known buckle a pivot lever that acts as a compensating mass is pivotably mounted in the buckle, but is connected to a push rod in a complicated and hence disadvantageous manner, with the push rod in turn linking the movements of the sliding key and the locking bar; accordingly, the pivot lever secures the locking bar in its locking position only indirectly via the push rod. Since for this reason the pivot lever must be matched not only to the mass of the locking bar but also to the movements of the push rod and the accelerating forces that act thereon, not only is the mass required for the pivot lever greater, but in addition the shock protection is composed of numerous components, the interaction of which must be accurately coordinated with one another. Inter alia, a retro fitting of existing buckles of the aforementioned type is therefore impossible.

It is therefore an object of the present invention to improve a buckle of the aforementioned general type in such a way that a functionally more reliable shock protection of the buckle is provided with few individual components.

SUMMARY OF THE INVENTION

The safety belt buckle of the present invention comprises: a housing having an insertion passage for the insertion tongue; spring-loaded ejector means disposed in the insertion passage of the housing; a locking latch that is biased in an opening direction and is pivotably mounted in the housing such that in a locking position the locking latch extends into a recess of the insertion tongue; a locking bar movably mounted in the housing at an angle to an insertion path of the insertion tongue, with the locking bar securing the locking latch in the locking position thereof; a sliding key that is guided transverse to a plane of movement of the locking latch for cancelling the locking position thereof via actuation of the locking bar; to protect the buckle from shock, compensating mass means mounted in the housing such that the compensating mass means is movable relative to the locking bar, the compensating mass means serving for fixing the locking bar in position, wherein during acceleration in the same direction as a pushing-in direction of the sliding key, the compensating mass means directly supports the locking bar and fixes the position thereof; and spring means supported on the buckle for spring-loading the compensating mass means toward a position that fixes the locking bar.

The invention proceeds from the principle that the compensating mass is movably disposed in the buckle body relative to the locking bar and directly supports the locking bar in the event of acceleration that is in the same direction as the pushing-in direction of the sliding key, and for that purpose is spring-loaded toward the position in which the locking bar is secured by a spring that is to be supported relative to the buckle either against the buckle body or against the locking latch.

This inventive teaching has the advantage that the locking bar is immediately secured against an automatic or self-opening in the event of acceleration forces that act in the pushing-in direction of the sliding key, because the mass inertia of the compensating mass prevents the locking bar from moving in the release position for the locking latch of the buckle. This inventive solution is particularly suitable for buckles that are subjected to tensioning loads, during which the deceleration energy available at the end of the tensioning path is inadequate for pushing the sliding key into the buckle, so that a shock protection of the buckle with respect to the acceleration forces that arise during deceleration of the buckle can be dispensed with. Such conditions apply in particular for safety belt buckles subjected to tensioning movement by spring force that supplies the drive energy. Since the compensating mass is movably disposed in the buckle body relative to the locking bar, it is released from the locking bar during deceleration of the buckle and therefore, during this stage, the locking bar is no longer influenced by the compensating mass.

Pursuant to a first specific embodiment of the invention, the compensating mass is provided translatorically, i.e. is longitudinally displaceably disposed in the buckle body, and in particular in the same plane relative to the pivot axis of the locking bar as the actuation projection of the sliding key, whereby these two components enclose or accommodate the locking bar therebetween. If the sliding key under these conditions is activated for unlocking the buckle, the spring-loading causes the compensating mass to yield to the pivoting movement of the locking bar as brought about by the sliding key.

Pursuant to a further specific embodiment of the invention, the compensating mass is rotationally designed in the form of a pivot lever that in a bow-shaped manner extends over the path of movement for the sliding key, with the pivot lever being provided with a stop member that cooperates with the locking bar and engages that end of the locking bar that secures the locking latch on the sliding key side. The pivot axis of the pivot lever, which acts as a compensating mass, is disposed between the planes of movement of the sliding key on the one hand and the locking surface of the locking bar on the other hand.

By providing a compensating mass that acts directly on the locking bar, the locking bar is secured against movement at the start of the tensioning process, i.e. when accelerating forces act in the pushing-in direction of the sliding key. To allow for a certain freedom for the pushing-in of the sliding key at the end of the tensioning process, the invention provides for an idle stroke between the actuating projection of the sliding key and the locking bar; by means of this idle stroke, the sliding key can slide into the buckle body without actuating the locking bar. This presupposes that the residual energy at the end of the tensioning path is not so large that the mass inertia of the sliding key, in addition to overcoming the idle stroke, also suffices to pivot the locking bar with the required force.

Pursuant to the invention, the safety belt buckle may, in addition to shock protection at the beginning of the tensioning process, also be designed in such a way that at the end of the tensioning procedure likewise no self-opening of the buckle takes place. In particular, if for the tensioning procedure pyrotechnical means are employed to supply the drive energy, the acceleration energy that has to be compensated for at the end of the tensioning path is so large that the mass inertia of the sliding key under the effect of the acceleration forces results in a pushing-in movement of the sliding key with such force that the locking bar is actuated to release the locking latch.

For this purpose, in one specific embodiment the invention provides for a second compensating mass that is longitudinally slidable in the buckle and that holds the locking bar in the position that secures the locking latch even when the locking bar is actuated by operation of the sliding key. For this purpose, the second compensating mass acts on the lower end of the locking bar opposite the point of attack or contact of the sliding key and holds the locking bar in the secured position for the locking latch by means of a hook-shaped formation that extends over the locking bar. The connection between the second compensating mass and the locking latch is thereby uncoupled, i.e. is provided with play, so that at the beginning of the tensioning process an independent movement of the components relative to one another is possible.

Pursuant to a further specific embodiment of the invention, to protect the buckle from shock at the end of the tensioning path, the sliding key itself is prevented from carrying out its pushing-in movement into the buckle body by providing on the pivot lever, which serves as the compensating mass, a stop member for arresting the sliding key. The pivoting of the pivot lever that occurs at the end of the tensioning path due to its mass inertia causes the arresting projection to enter into the path of movement of the sliding key, whereby the idle stroke that first has to be overcome by the sliding key is utilized to bring the pivot lever and its associated projection into the path of movement of the sliding key. Thus, the sliding key is immobilized and can no longer act upon the locking bar.

BRIEF DESCRIPTION OF THE DRAWINGS

Specific embodiments of the invention are illustrated in the drawing and will be described subsequently. Shown are.

DESCRIPTION OF PREFERRED EMBODIMENTS

Figure 1:
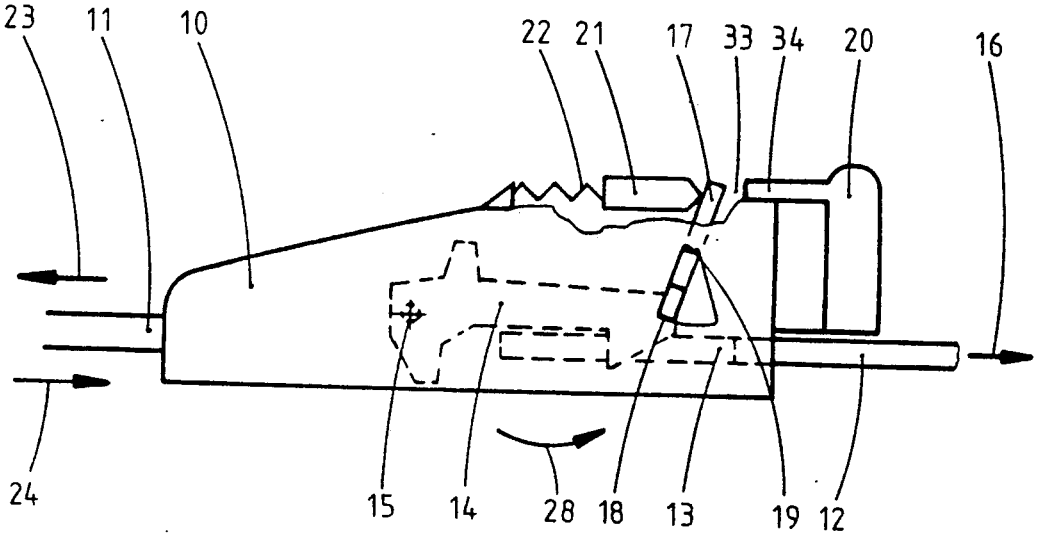
FIG. 1 a diagrammatic view of a locked safety belt buckle, including a translatorically arranged compensating mass, FIG. 2 a locked safety belt buckle with a rotationally mounted compensating mass, FIG. 3 a safety belt buckle having two translatorically mounted compensated masses shown in the locking position, FIG. 4 the buckle of FIG. 3 at the start of the tensioning movement, FIG. 5 the buckle of FIG. 3 at the end of the tensioning movement, FIG. 6 the buckle of FIG. 2 with a shock protection for the forces that occur at the end of the tensioning path.

A lock or buckle body 10 is secured to a holding means or strap 11, which in turn is connected to the vehicle via a non-illustrated tensioning means. A buckle or insertion tongue or lug 12 can be inserted into the buckle body 10 and has a recess 13. A locking latch or safety catch 14 is mounted in the buckle body 10 in such a way as to be pivotable about an axis 15, with the locking latch having a tendency to open when the buckle or insertion tongue 12 is loaded in the direction of the arrow 16. In the locked position shown in FIG. 1, the locking latch 14 extends into the recess 13 of the insertion tongue 12 to lock the same. In this position, the locking latch 14 is secured by a locking bar 17 that is mounted in the buckle body 10 in such a way as to move at an angle to the insertion path for the insertion tongue 12; a locking surface 18 of the locking bar rests against the locking latch 14, with the locking bar being pivotable about an axis 19 between the securing position for the locking latch 14 shown in FIG. 1 and a release position.

Displaceably guided in the buckle body 10 is a push or sliding key 20, which includes an actuating projection 34 as the actuating element for the locking bar 17, and which in its non-actuated position is disposed at a distance from the locking bar 17, with this distance representing an idle stroke. When the sliding key 20 is displaced, the actuating projection 34 of the sliding key 20 engages that side of the locking bar 17 that is opposite the locking surface 18 of the locking bar.

Longitudinally displaceably disposed in the buckle body 10 is a compensating mass 21 that, due to the fact that it is biased by a spring 22 supported against the buckle body 10, bears against the locking bar 17 in the locked position of the buckle and presses the locking bar into the securing position for the locking latch 14. In this connection, the compensating mass 21 is disposed in the same plane as the actuating projection 34 of the sliding key 20, with the actuating projection 34 and the compensating mass 21 accommodating the locking bar 17 between them and thus acting upon it from both sides. Neither the actuating projection 34 of the sliding key 20 nor the compensating mass 21 is connected to the locking bar 17, and are consequently uncoupled therefrom.

If at the beginning of a tensioning movement an acceleration of the buckle body 10 in the direction of the arrow 23 occurs, which direction of acceleration corresponds to the direction of push of the sliding key, the mass inertia of the locking bar 17 will tend to impart to the latter a movement directed counterclockwise (arrow 28), which translates to a displacement of the locking bar 17 from its securing position into a no longer securing position in which the buckle, due to the self-opening tendency of the locking latch 14, immediately opens. This movement of the locking bar 17 has to be prevented, with this being accomplished by the counteracting inertia of the compensating mass 21, which remains in the illustrated position due to its own mass inertia and prevents pivoting of the locking bar 17.

At the end of the tensioning procedure, an acceleration occurs in the direction of the arrow 24, with this acceleration being accompanied by a relative movement between the stationary compensating mass 21 and the buckle body 10, whereby the compensating mass 21 is released from bearing against the locking bar 17. At the same time, a relative movement takes place between the sliding key 20 and the buckle body 10; however, the accelerating forces, which act in the direction of the arrow 24, are not sufficient to cause the sliding key 20, after having overcome the idle stroke 33, to effect pivoting of the locking bar 17.

If unlocking of the buckle is desired, the sliding key 20 is pushed into the buckle body 10, with the actuating projection 34, after having overcome the idle stroke 33, pivoting the locking bar 17 into its no longer securing position; the compensating mass 21 now yields to the pivoting movement of the locking bar 17.

Figure 2:
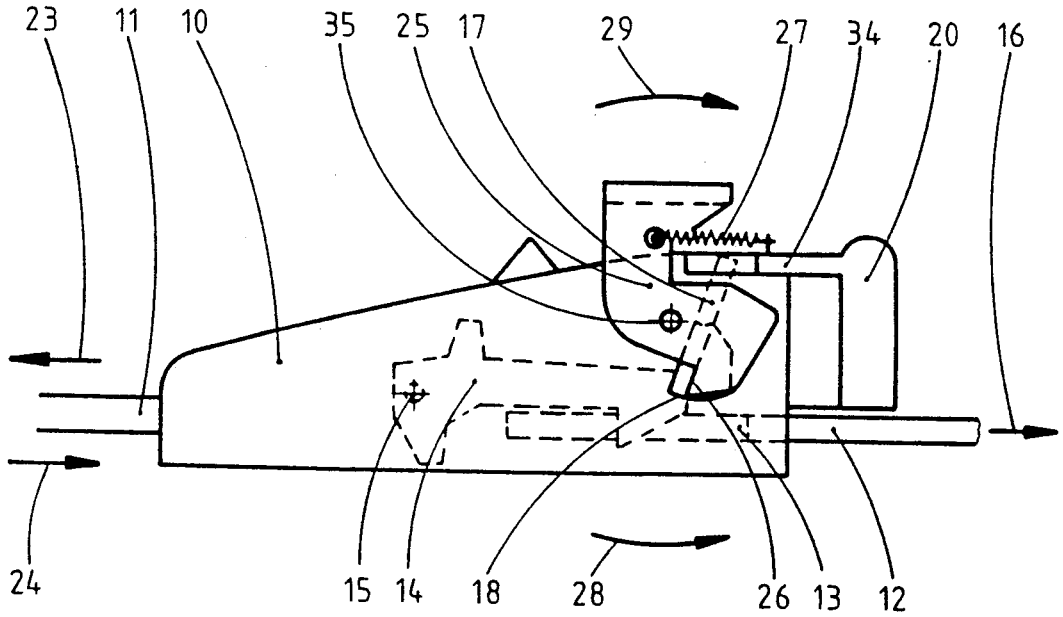

In the specific embodiment illustrated in FIG. 2, the compensating mass is rotationally mounted, and in particular in the form of a pivot lever 25 that is pivotable about an axis 35 provided between the planes of movement of the sliding key 20 on the one hand and the locking surface 18 of the locking bar 17 on the other hand. The pivot lever 25 has an approximately "S" shaped configuration, with a stop member 26 being provided at the lower end of the "S"; on the side of the sliding key, this stop member bears against the locking bar 17. The pivot lever 25 is held by a tension spring 27 on the buckle body 10, and is spring biased in the securing position shown in FIG. 2.

The pivot lever 25, which serves as the compensating mass, is spring-loaded in its normal position, in which its lower stop member 26 bears against the locking bar 17 in its securing position. If in the event of a tensioning of the buckle body 10 an acceleration occurs in the direction of the arrow 23, the thereby caused tendency of the locking bar 17 to move in the direction of the arrow 28 is precluded by the counteracting inertia of the pivot lever 25, which has a clockwise moment of inertia (arrow 29) and thereby via the stop member 26 fixes the locking bar 17 in position, since pursuant to the invention the mass and leverage of the pivot arm are designed to be greater than the mass and leverage of the locking bar 17. In other respects, the conditions of this embodiment correspond to those described in conjunction with FIG. 1.

Figure 3:
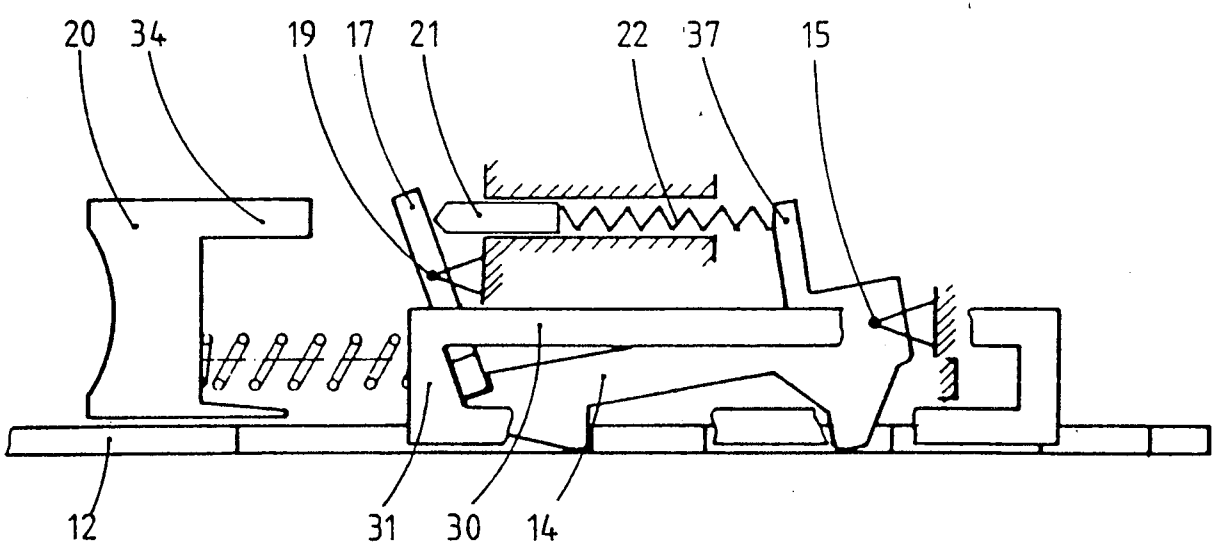
Figure 4:
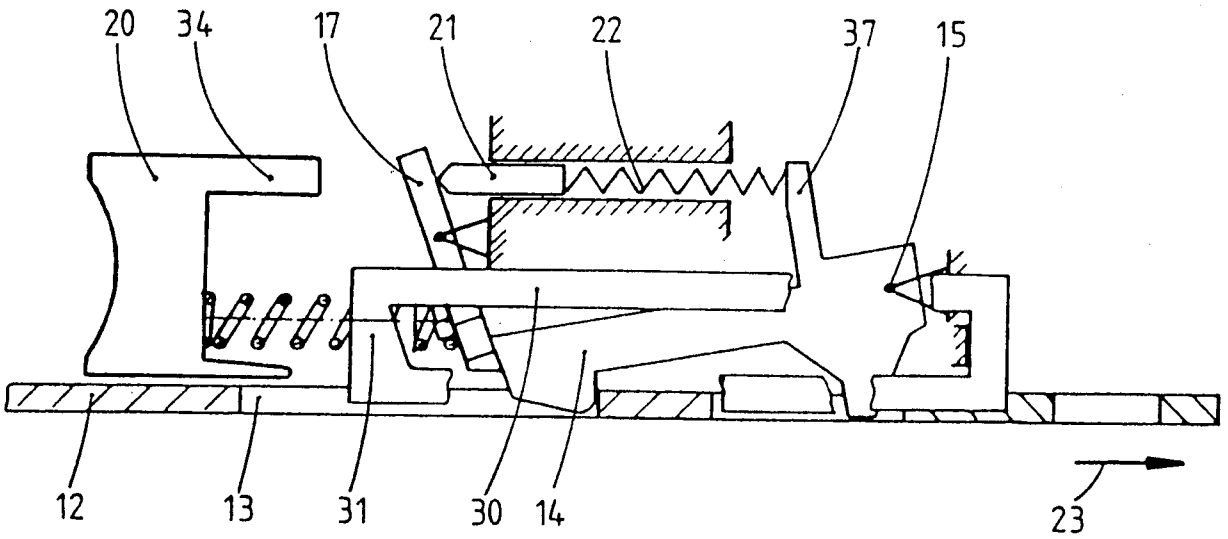
Figure 5:
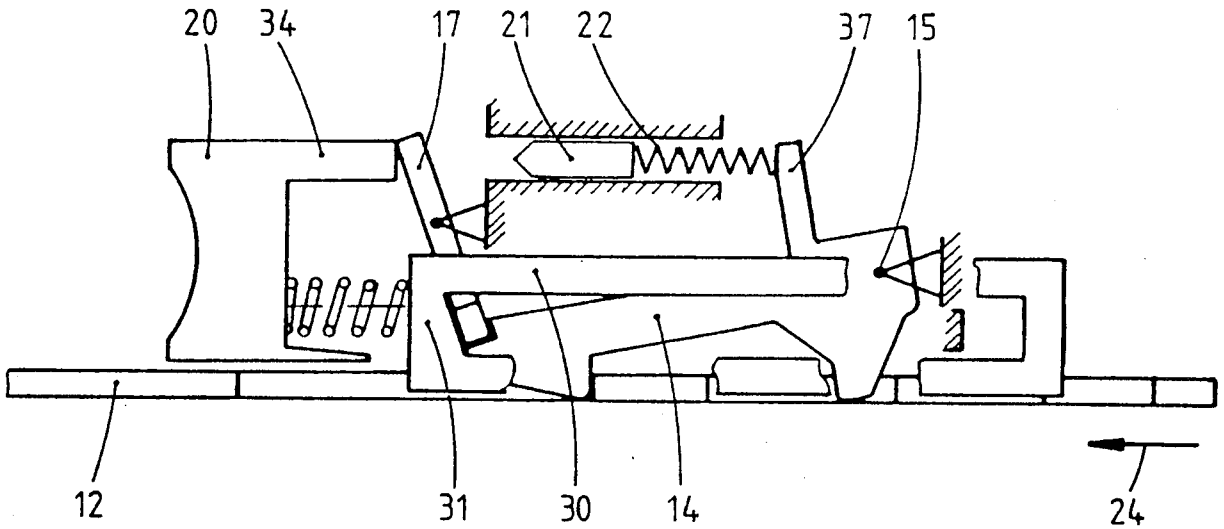

In the embodiment of the invention illustrated in FIGS. 3 to 5, in addition to a shock protection of the locking bar due to accelerations that occur at the beginning of the tensioning path in the push-in direction of the sliding key (arrow 23), a shock protection is also realized to protect against the accelerations (arrow 24) that occur at the end of the tensioning path. For this purpose, for the type of buckle illustrated and described in conjunction with FIG. 1, a second compensating mass 30 is longitudinally displaceably mounted in the buckle body 10, and in particular on that side of the buckle body 10 that is remote from the sliding key 20. The compensating mass engages the locking bar 17 at that end of the locking bar 17 that is opposite to the point of contact of the actuating projection 34 of the sliding key 20, with the compensating mass extending about this end by means of a hook-shaped formation 31.

The relative positions of the components to one another in the position of rest of the buckle can be seen from FIG. 3. If at the beginning of a tensioning process, as shown in FIG. 4, an acceleration in the direction of the arrow 23 occurs, the locking bar 17 is secured by the compensating mass 21 as described in conjunction with FIG. 1. Since the second compensating mass 30 also has the same inertial effect, the compensating mass 30 is released from the locking bar, which, however, has no effect upon securement of the locking bar 17.

FIG. 5 illustrates the conditions that occur at the end of the tensioning path, when the buckle body 10 is accelerated in the direction of the arrow 24. In so doing, the sliding key 20 is displaced until the actuating projection 34 abuts against the locking bar 17 and tries to pivot the same. Since at the same time the compensating mass 30, due to its mass inertia, is shifted in the same direction as the sliding key 20, the hook-shaped formation 31 of the compensating mass 30 abuts against that end of the locking bar 17 that is opposite to the point of contact of the sliding key and holds the locking bar in position against the action of the sliding key. Consequently, the buckle is protected against shock even at the end of the tensioning path.

In the embodiments illustrated in FIGS. 1 and 2, the support of the compensating masses 21, 25 in each case takes place against the buckle body 10; the embodiments of FIGS. 3 to 5 illustrate a support of the compensating mass 21 against the locking latch 14, with the spring 22 being supported against an upright projection 37 of the locking latch 14. A similar support can also be effected for the spring 27 in the embodiment illustrated in FIG. 2. The two supports for the springs 22, 27 are equivalent to one another and do not affect the movements that take place when the buckle is tensioned.

Figure 6:
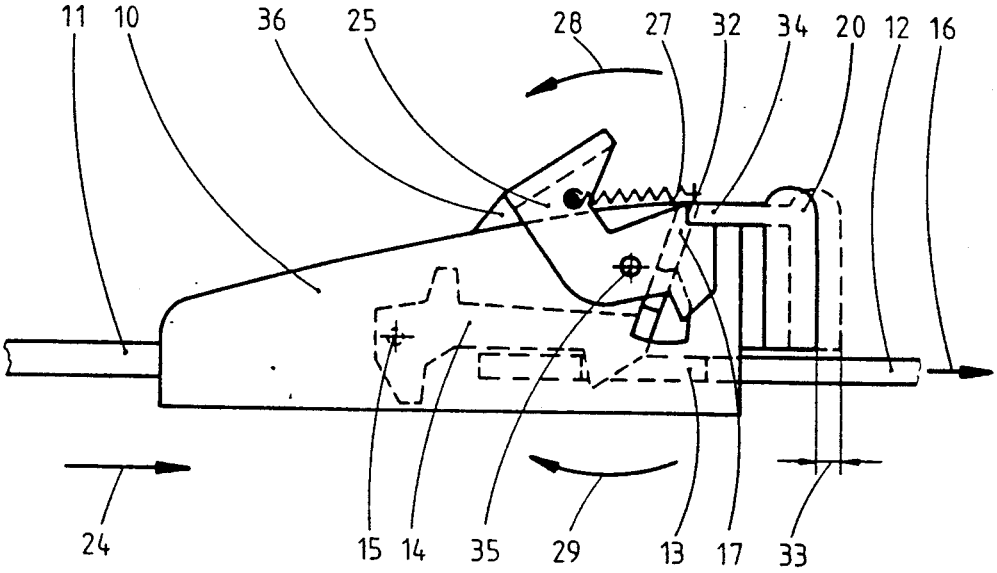

FIG. 6 illustrates a specific embodiment o the invention where the shock protection of the buckle at the conclusion of the tensioning path is effected by a fixing of the sliding key 20, with this embodiment corresponding to the embodiment of the invention illustrated in FIG. 2. For shock protection of the buckle, the pivot member 25 is merely provided at the upper side of the "S" loop or configuration with a stop member 32 for the sliding key 20, which in its plane of movement is adapted to enter into the upper "S" bend of the pivot lever 25.

Due to the mass inertia, the pivot lever 25, when an acceleration occurs in the direction of the arrow 24, pivots in the direction of the arrow 28, thereby causing the stop member 26 for the locking bar 17 to be released therefrom. However, this is of no significance because when acceleration occurs in the direction of the arrow 24, the locking bar 17 is in any event subjected to a torque that exercises a closing action in its secured position. However, the pivoting of the pivot lever 25 causes the stop member 32 to enter into the trajectory of the sliding key 20 before the sliding key 20 has overcome the idle stroke 33 to engage the locking bar 17. Thus, due to the stop member 32 of the pivot lever 25, the pushing-in movement of the sliding key 20 is obstructed and can thus no longer act upon the locking bar 17 in the sense of an opening movement for the buckle.

The present invention is, of course, in no way restricted to the specific disclosure of the specification and drawings, but also encompasses any modifications within the scope of the appended claims.

We claim:

1. A buckle for a safety belt, especially for motor vehicles, for receiving and locking an insertion tongue, comprising:

a housing having an insertion passage for said insertion tongue;

spring-loaded ejector means disposed in said insertion passage of said housing;

a locking latch that is biased in an opening direction and is pivotably mounted in said housing such that in a locking position said locking latch extends into a recess of said insertion tongue;

a locking bar movably mounted in said housing at an angle to an insertion path of said insertion tongue, with said locking bar securing said locking latch in said locking position thereof;

a sliding key that is guided transverse to a plane of movement of said locking latch for cancelling said locking position thereof via actuation of said locking bar;

to protect said buckle from shock, compensating mass means mounted in said housing such that said compensating mass means is movable relative to said locking bar, said compensating mass means serving for fixing said locking bar in position, wherein during acceleration in the same direction as a pushing-in direction of said sliding key, said compensating mass means directly supports said locking bar and fixes the position thereof; and spring means supported on said buckle for spring-loading said compensating mass means toward a position that fixes said locking bar.

2. A safety belt buckle according to claim 1, in which said compensating mass means, and an actuating projection of said sliding key, are respectively disposed in the same plane relative to a pivot axis of said locking bar and accommodate said locking bar between them.

3. A safety belt buckle according to claim 2, in which said compensating mass means is longitudinally displaceably guided in said housing and upon actuation of said locking bar via said sliding key yields to the movement of said locking bar.

4. A safety belt buckle according to claim 1, in which said compensating mass means is in the form of a pivot lever that extends over a path of movement for said sliding key in a bow-shaped manner, with said pivot lever being pivotably mounted in said housing against the force of said spring means, which holds said pivot lever in the position where it fixes said locking bar.

5. A safety belt buckle according to claim 4, in which said pivot lever is provided with a stop member that cooperates with said locking bar and that, on a side of said locking bar facing said sliding key, acts upon an end of said locking bar that secures said locking latch.

6. A safety belt buckle according to claim 4, in which said pivot lever has a pivot axis that is disposed between the planes of movement of said sliding key on the one hand and a locking surface of said locking bar on the other hand.

7. A safety belt buckle according to claim 5, in which said pivot lever, which forms said compensating mass means, is provided with a second stop member for fixing the position of said sliding key in the event of acceleration acting counter to said pushing-in direction of said sliding key.

8. A safety belt buckle according to claim 7, in which said stop members of said pivot lever, relative to a vertical plane of movement of said sliding key, are respectively disposed on opposite sides of said pivot lever.

9. A safety belt buckle according to claim 7, in which said housing is provided with a support means to limit the pivot movement of said pivot lever.

10. A safety belt buckle according to claim 7, in which said pivot lever has an essentially S-shaped configuration including an upper portion and a lower portion, with said first-mentioned stop member for said locking bar being disposed at an outer end of said lower portion of said S-shaped configuration, and said second stop member for said sliding key being disposed at a bend of said lower portion of said S-shaped configuration, and with said upper portion of said S-shaped configuration having a bend that provides freedom of movement for said sliding key during opening of said buckle.

11. A safety belt buckle according to claim 1, in which, during unlocking of said buckle, an actuating projection of said sliding key passes through an idle stroke prior to engagement against said locking bar.

12. A safety belt buckle according to claim 1, in which, to protect said buckle from shock in the event of acceleration acting counter to said pushing-in direction of said sliding key, a second compensating mass means is longitudinally displaceably guided in said housing and holds said locking bar in its position where it secures said locking latch.

13. A safety belt buckle according to claim 12, in which said second compensating mass means acts on an end of said locking bar remote from an end thereof that serves for engagement with said sliding key, with said second compensating mass means being provided with a hook-shaped formation that extends over said locking bar to hold same in its position where it secures said locking latch.

14. A safety belt buckle according to claim 12, which includes means for connecting said second compensating mass means and said locking bar with play.

15. A safety belt buckle according to claim 1, in which said spring means for spring-loading said compensating mass means is supported on said housing.

16. A safety belt buckle according to claim 1, in which said spring means for spring-loading said compensating mass means is supported on a projection of said locking latch.

* * * * *

UNITED STATES PATENT AND TRADEMARK OFFICE

CERTIFICATE OF CORRECTION

PATENT NO. : 5,163,207

DATED : Nov. 17, 1992

INVENTOR(S) : Krautz et al

It is certified that error appears in the above-identified patent and that said Letters Patent is hereby corrected as shown below:

On the title page, Item
[22] PCT Filed: Mar. 13, 1990

Signed and Sealed this

Fifth Day of October, 1993

Bruce Lehman

*Attest:*

BRUCE LEHMAN

*Attesting Officer*

*Commissioner of Patents and Trademarks*